US006358118B1

(12) United States Patent
Boehm et al.

(10) Patent No.: US 6,358,118 B1
(45) Date of Patent: Mar. 19, 2002

(54) FIELD CONTROLLED POLISHING APPARATUS AND METHOD

(75) Inventors: Robert G. Boehm, Dresden (DE); John M. Boyd, Atascadero, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/608,462

(22) Filed: Jun. 30, 2000

(51) Int. Cl.[7] ..... B24B 49/16; B24B 7/22

(52) U.S. Cl. ..... 451/24; 451/41; 451/307; 451/303

(58) Field of Search ..... 451/296, 303, 451/307, 5, 24, 173, 168, 288, 41

(56) References Cited

U.S. PATENT DOCUMENTS 5,558,568 A 9/1996 Talieh et al.
5,916,012 A 6/1999 Pant et al.
5,931,718 A * 8/1999 Komanduri et al. ..... 451/36
5,961,372 A * 10/1999 Shendon ..... 451/41
5,980,368 A * 11/1999 Chang et al. ..... 451/303
6,086,456 A * 7/2000 Weldon et al. ..... 451/41
6,146,245 A * 11/2000 Kremen et al. ..... 451/36

OTHER PUBLICATIONS

Peter Godwin, "The Car That Can't Crash", The New York Times Magazine, pp. 58–60, Jun. 11, 2000.

* cited by examiner

*Primary Examiner*—Robert A. Rose
(74) *Attorney, Agent, or Firm*—Brinks Hofer Gilson & Lione

(57) ABSTRACT

A polishing tool includes a polish pad, a bladder, a fluid, and a flux guide. A bladder containing fluid supports the polishing pad that is positioned adjacent to a surface to be polished. Flux guides positioned along a portion of the bladder direct a field or a magnetic flux to selected locations of the bladder. The method of polishing a surface adjusts the field or the magnetic flux emanating from the flux guides which changes the mechanical properties of the fluid. By adjusting the magnitude of the field or level of magnetic flux flowing from the flux guides independent pressure adjustments occur at selected locations of the bladder that control the polishing profile of the surface.

36 Claims, 2 Drawing Sheets

FIELD CONTROLLED POLISHING APPARATUS AND METHOD

FIELD OF THE INVENTION

This invention relates to the fabrication of integrated circuits, and more particularly, to a manufacturing apparatus and a method that planarizes wafer surfaces.

BACKGROUND

The fabrication of integrated circuits involves a sequence of steps. The process can involve the deposition of thin films, the patterning of features, the etching of layers, and the polishing of surfaces to planarize or remove contaminants.

Chemical Mechanical Polishing ("CMP") is one process that planarizes surfaces and removes contaminants. A CMP process involves subjecting a semiconductor wafer to a rotating pad and a chemical slurry. The polishing process is a grinding of the wafer surface and a chemical reaction between the surface and the chemical slurry.

Planarizing and cleaning wafer surfaces by a CMP process can be very effective but also can be difficult to control. Removal rates by a CMP process can change with the rotation rates of the pad and the wafer, by the pH or flow rates of the chemical slurry, or by the distribution of the chemical slurry near the center of the wafer, for example. Even variations in feature densities or pressure variations across the polishing pad can cause variations in the removal rates of wafer layers and contaminants.

Controlling the removal rates can be a very difficult process given that many other parameters can also cause variations. Accordingly, there is a need to control the removal rates across an entire or a selected portion of a wafer surface.

DETAILED DESCRIPTION OF THE PRESENTLY PREFERRED EMBODIMENTS

Embodiments of the apparatus and method of the present invention discussed below provide significant improvements for controlling surface removal rates and polishing profiles by a CMP or a silicon polishing process. The apparatus and the method utilize force modulation to control these rates across an entire or a selected portion of a wafer surface. The apparatus and the method substantially eliminate surface variations between the center, middle, and edge regions of a semiconductor wafer surface that can occur in CMP or silicon polishing processes.

Figure 1:
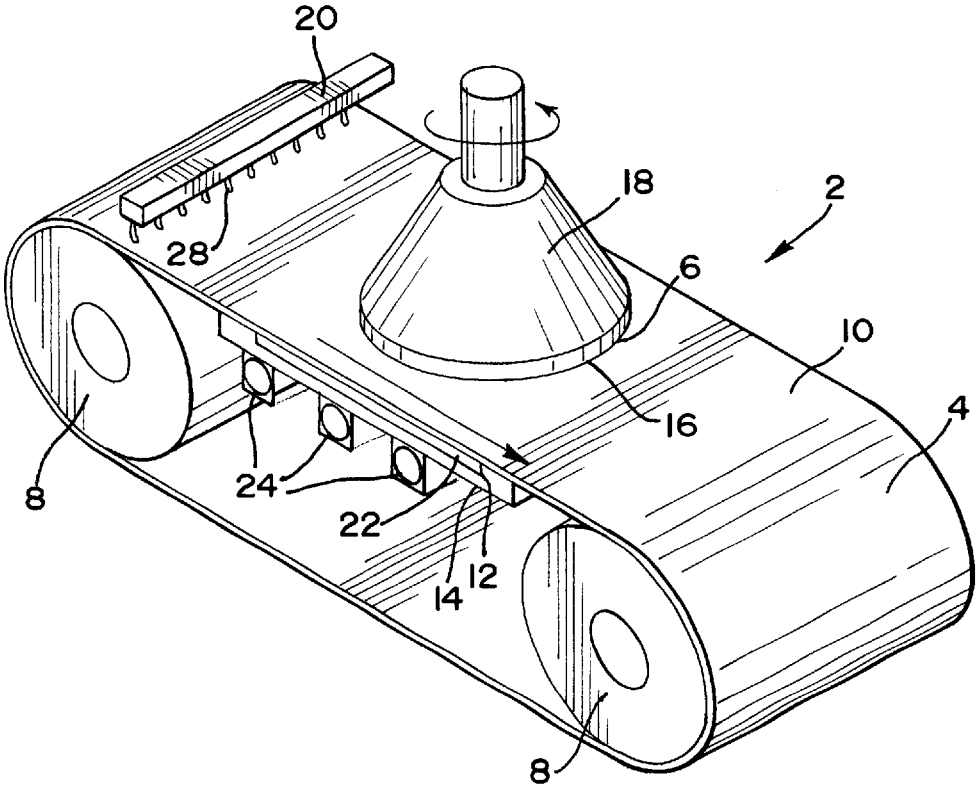
FIG. 1 is a perspective view of a preferred embodiment.

FIG. 1 illustrates a perspective view of a preferred embodiment of the invention. The apparatus 2 preferably employs a belt 4 that moves linearly with respect to a semiconductor wafer 6. The belt 4 travels over rollers 8 that are driven in rotation by a motor or any other device that imparts a linear motion to the belt 4 with respect to the semiconductor wafer 6. A polishing pad 10 is affixed to the outer surface of the belt 4 and makes contact with the wafer surface.

The belt 4 is supported, in part, by a hollow fluid filled structure that serves as a receptacle for a powder, a fluid, or a gas. The hollow structure or bladder 12 provides support to the underside of the belt 4 against downward forces that press against the polishing pad 10 and the belt 4. A stiff polymer support or platen 14 disposed on the underside of the bladder 12 supports the bladder 12 against movement away from the belt 4. Beneath the pad 10 are flux guides that are connected to one or more Direct Current ("DC") or Alternating Current ("AC" ) power supply/supplies 26 shown in FIG. 2. The flux guides are used to either direct a field or a magnetic flux to selected locations of the bladder 12 or prevent a field or a magnetic flux from reaching selected regions of the bladder 12.

The semiconductor wafer 6, which may be comprised of silicon scaled to the dimensions of a given circuit, is retained by a wafer carrier 16 enclosed by a housing 18. The semiconductor wafer 6 is held in place by a retention device and/or by a vacuum. In this preferred embodiment, the wafer 6 is rotated with respect to the belt 4 by the orbit of the wafer carrier 16. The rotation of the wafer 6 distributes contact between the pad 10 and the wafer 6 when the wafer 6 is pressed against the belt 4. The rotation of the wafer 6 allows for a substantially uniform removal rate or polishing profile of the wafer surface.

Figure 2:
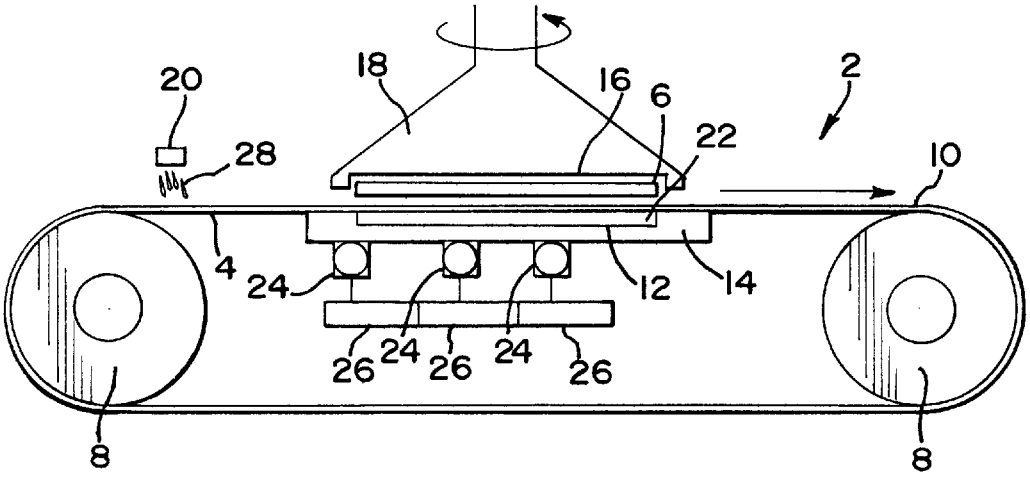
FIG. 2 is a cross-sectional view of FIG. 1.

As shown in FIGS. 1 and 2, a dispensing member 20 is positioned above the pad 10 to dispense a chemical slurry 28 to an outer surface of the pad 10. The chemical slurry 28 can be a mixture of solid particles and liquid such as a colloidal silica and a pH-controlled liquid. Of course, other chemical slurry materials can also be used.

Other details of this preferred embodiment can be found in U.S. Pat. No. 5,916,012 entitled "Control of Chemical-Mechanical Polishing Rate Across a Substrate Surface for a Linear Polisher" assigned to the assignee of this invention. This patent is hereby incorporated by reference in its entirety.

The apparatus and method of this preferred embodiment further includes a material or a fluid means having a variable magnetic flux density or a variable viscosity such as a magnetic fluid 22. The magnetic fluid 22 is held within the bladder 12. Examples of such magnetic fluid 22 include a mixture of oil and ferromagnetic shavings, iron filings and gunk (i.e. a greasy substance), magneto-rheological fluid, or magnarheological fluid, for example. The magnetic fluid 12 functions like an active suspension system that compensates for CMP or silicon polishing process variations caused by parameter variances such as wafer surface irregularities, belt sag, linear belt rotation rates, slurry flow rates, device pattern densities, pitch areas, and wafer rotation rates, for example. The magnetic fluid 22 can compensate for these and many other process parameters that cause variation in the polishing profiles of the wafer layers. The magnetic fluid 22 also provides the necessary counteracting forces against the wafer 6 when the wafer carrier 16 presses the wafer 6 against the polishing pad 10.

Figure 3:
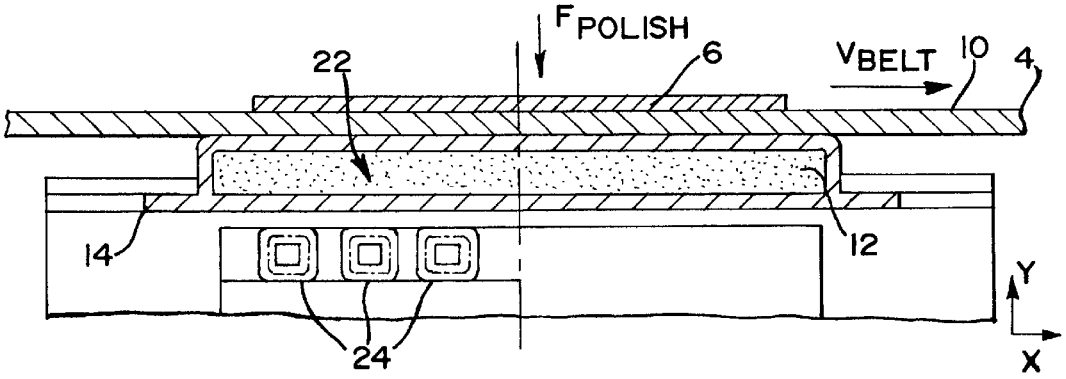
FIG. 3 is a partial cross-sectional view of FIG. 1.

Referring to FIG. 3, a partial cross-sectional view of this preferred embodiment is shown. Beneath the wafer 6 is the polishing pad 10 disposed on the belt 4. The pad 10 and the belt 4 move in a linear direction with respect to the wafer 6. Preferably, a device or feature side of the wafer 6 is positioned above the polishing pad 10. A stationary bladder 12, preferably made of a gasket or a flexible membrane material throughout, underlies the belt 4 to counteract or dampen downward forces. Besides having a low resistance to the linear motion of the belt 4, the bladder 12 preferably has other attributes including resistance to puncture, durability, a high resistance to wear, and a low magnetic flux resistivity. In this preferred embodiment, a synthetic resin such as polytetrafluoroethylene or Teflon coats the outer surface of the bladder 12 that underlies the belt 4. Preferably, the synthetic resin is not vulnerable to attack by a variety of chemicals, retains its physical properties over a wide temperature range, and has a low coefficient of friction.

As shown, a plurality of coils 24 are positioned below the bladder 12. In this preferred embodiment, the coils 24 are DC coils that serve as flux guides to direct an electric field, a magnetic field, an electromagnetic field, or a magnetic flux to selected locations of the bladder 12. The DC coils 24 illustrated in FIGS. 1–3 and FIG. 5 preferably generate uniform or differential fields that pass through the magnetic fluid 22 enclosed by the bladder 12. As the fields pass through portions of the magnetic fluid 22, those portions of the magnetic fluid 22 change viscosity and prevent some of the magnetic fluid 22 from flowing to sections of the bladder 12. The strength of the magnetic fluid's 22 resistance to flow is directly proportional to the rate of change of the field and/or the strength of the field. As the strength of the field increases, the magnetic density of the magnetic fluid 22 increases, which makes a smaller volume of the magnetic fluid 22 available to transfer the motion of a downward and/or a lateral force to other volumes of the magnetic fluid 22. By altering the viscosity of selected portions of the magnetic fluid 22, the apparatus and method of this preferred embodiment can generate many desired pressure profiles in support of the underside of the belt 4 and the polishing pad 10 and thus compensate for many polishing and grinding process parameters that cause polishing profile variations.

The degree of control and adjustment available to this preferred embodiment of the invention depends on a number of factors including, for example, the linear speed of the belt 4, the rotational speed of the wafer 6, the alignment of the wafer 6 and the polishing pad 10, the position of the flux guides, the shape of the flux guides, and the strength of the fields emanating from the flux guides. In the preferred embodiment illustrated in FIG. 3, the flux guides are coils 24 that have a substantially circular cross-section and are positioned across a width of the bladder 12. Preferably, the flux guides shapes and sizes emanate the desired field intensity to the desired locations. It should be noted, however, that flux guides are not limited to the illustrated dimensions, lengths, or the cross-sections of the coils 24 shown in the accompanying figures. Thus, the substantially circular cross-sectional shapes of the coils 24, their positions across the width of the bladder 12, and their illustrated diameters, illustrate only a few of the many forms that this aspect of the invention can take. The coils 24, for example, can have a polygonal cross-section and/or be positioned across the entire or a portion of the width or the length of the bladder 12.

In the embodiment shown in FIG. 3, the magnetic flux density or viscosity of selected portions of the magnetic fluid 22 is independently controlled by controlling the field emanating from one or more coils 24 adjacent to the selected portions of the fluid 22. This control provides a spatially controllable support for the polishing process. In use, the field emanating from the coils 24 can also overlap and thus provide a substantially uniform controllable support.

One or more power supplies 26 provide the desired DC current separately or collectively to the coils 24 shown in FIG. 2. In this preferred embodiment, the power supplies 26 are designed to the requirements of the polishing and grinding application. It should be understood that the type (i.e. manual or programmable) and the number of power supplies used in this preferred embodiment depend on the application and that a controller, such as a processor for example, can control the level of current flowing through each coil 24 separately or collectively and thus control the field(s) radiating through selected portions of the magnetic fluid 22.

Given that the polishing profile of a wafer surface is achieved by directing field(s) to selected locations of the bladder 12, the invention encompasses any structure that achieves that function. For example, the flux guides are not limited to current controlled coils 24 or even magnets. In alternative preferred embodiments, the flux guides can be electrodes positioned along the surface of the bladder 12, for example. Simply by passing current through selected electrodes and through selected portions of the magnetic fluid 22, the viscosity of the magnetic fluid 22 changes, which creates desired pressure profiles in support of the belt 4 and polishing pad 10 and creates the desired polishing profile(s) of the wafer 6. Likewise, the fluid encompasses any material in any physical state (i.e. solid, liquid, or gas) that can change mechanical properties when exposed to a magnetic field, an electromagnetic field, or a magnetic flux.

Furthermore, although many of the preferred embodiments have been described in reference to a linear polishing apparatus and method, they can be readily adapted to any polishing apparatus and method. For example, circular polishing tools or tools designed to the contour of the wafer 6 or any other material can be provided with the above described spatially controllable modulated force(s).

Figure 4:
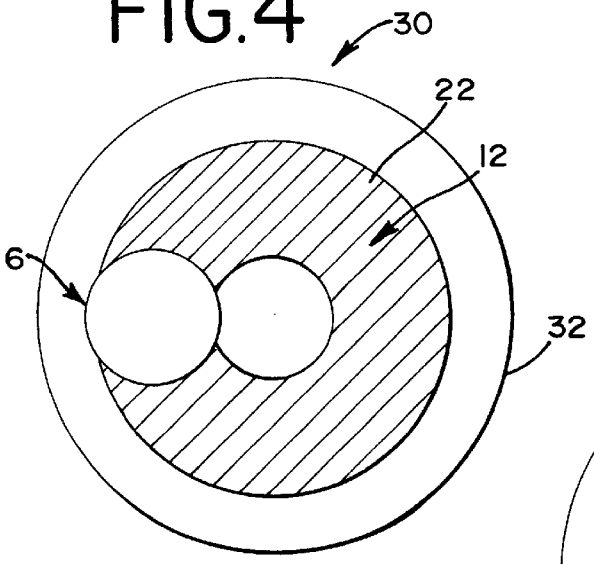
FIG. 4 is a cross-sectional view of an alternative preferred embodiment incorporated in a rotary tool.
Figure 6:
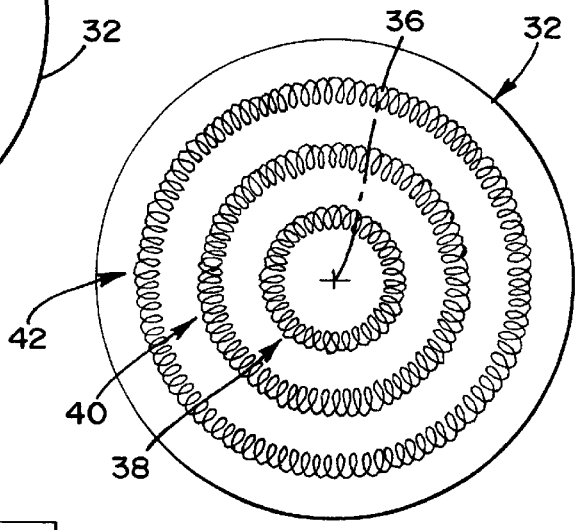
FIG. 6 is a partial top view of a platen and magnetic fields of FIG. 5.
Figure 5:
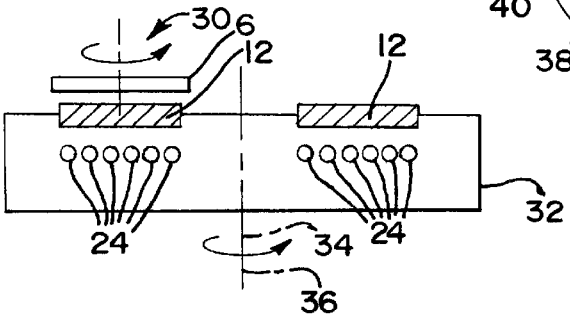
FIG. 5 is a partial cross-sectional view of FIG. 4.

In yet another alternative embodiment, the apparatus and method of the invention can be adapted to a rotary polishing tool and/or an orbital system. In a preferred embodiment shown in FIGS. 4 and 5, a rotary polishing tool 30 includes an annular shaped bladder 12 supported by a rotary platen 32. The center of the bladder 12 is positioned about an axis 34 substantially coincident with a rotational axis 36 of the rotary platen 32. Coils 24 are disposed underneath the bladder 12 such that the coils 24 generate radially symmetrical magnetic fields 38, 40, and 42 that are substantially centered about axis 36 as shown in FIG. 6. It should be noted that the coils 24 are not limited to an annular shape or the illustrated annular cross-sections, diameters, or dimensions shown in FIG. 5 as this aspect of the invention can take many other forms. A few examples of rotary and orbital tools that can incorporate the invention include the Mirra Ebara 222™ by Applied Materials, the Auriga C™ by SpeedFam-IPEC and the 776 ™ by Orbital Systems. Of course, other tools including other rotary and orbital tools can also incorporate the invention.

From the forgoing description, it should be apparent that a wafer surface without circuitry or features, such as a pure silicon surface or layer for example, may be polished by the invention. Also, it should be apparent that the bladder 12 is not limited to any shape or dimension. FIGS. 1–5 illustrate only a few of the many shapes and dimensions the bladder 12 can take.

The field or magnetic flux control described above provides a number of advantages to the grinding and polishing of surfaces. By using fields or magnetic flux in a CMP or a wafer polishing apparatus and method, for example, there is no risk of contamination to the chemical slurry 28 or polishing process. The number of flux guides and their positions can be modified as desired, improving process control and reducing set-up times. The field or magnetic flux-control apparatus and method lends itself to open loop, closed loop, and automated control making it readily adaptable to many fabrication processes and facilities. The flux guides are highly reliable and further provide precise control of polishing profiles of an entire or a selected portion of a wafer surface.

The foregoing detailed description describes only a few of the many forms that the present invention can take and should therefore be taken as illustrative rather than limiting. It is only the following claims, including all equivalents that are intended to define the scope of the invention.

What is claimed is:

1. A polishing tool utilized to polish a material having a substantially planar surface, comprising:

a polishing pad disposed adjacent to said substantially planar surface;

a bladder disposed along a portion of said polishing pad to support said polishing pad;

a fluid disposed within said bladder; and at least one flux guide disposed along a portion of said bladder to direct a magnetic field to selected locations of said bladder for controlling a polishing profile of said substantially planar surface by adjusting the mechanical properties of said fluid.

2. The polishing tool of claim 1 wherein said polishing pad is a linearly moving polishing pad.

3. The polishing tool of claim 1 further comprising a polishing belt disposed along the underside of said polishing pad.

4. The polishing tool of claim 1 further comprising a polytetrafluoroethylene coating disposed on a surface of said bladder.

5. The polishing tool of claim 1 wherein said fluid comprises a magnetic fluid.

6. The polishing tool of claim 1 wherein said fluid comprises a mixture of oil and ferromagnetic shavings.

7. The polishing tool of claim 1 wherein said fluid comprises a magneto-rheological fluid.

8. The polishing tool of claim 1 wherein said fluid exerts at least one counteracting force against a force pressing said material onto said pad.

9. The polishing tool of claim 8 wherein said magnetic field directed to said locations of said bladder produces a counteracting force that is proportional to said mechanical properties of a portion of said fluid.

10. The polishing tool of claim 8 wherein said magnetic field directed to said locations of said bladder produces a counteracting force that is proportional to the magnitude of said magnetic field.

11. The polishing tool of claim 1 wherein said fluid has a viscosity proportional to the magnitude of said magnetic field directed to said selected locations of said bladder.

12. The polishing tool of claim 1 wherein said at least one flux guide comprises a plurality of flux guides that emanate said magnetic field to selected locations of said bladder.

13. The polishing tool of claim 12 wherein said plurality of flux guides are coupled to a power supply.

14. The polishing tool of claim 12 wherein said plurality of flux guides are coupled to a controller that independently controls the magnitude of said magnetic field emanating from said flux guides to produce a plurality of counteracting forces against a force pressing said material against said pad.

15. An apparatus for adjusting a polishing profile of a wafer surface, comprising:

a continuously moving polishing pad;

a support disposed along the underside of said polishing pad;

a bladder disposed on top of a portion of said support and along a portion of said polishing pad;

a fluid disposed within said bladder, and at least one flux guide disposed along the underside of said bladder, said flux guide directing a magnetic field to selected locations of said bladder to generate at least one counteracting force against a force pressing said wafer against said pad by adjusting the flux density of a portion of said fluid.

16. The apparatus of claim 15 wherein said polishing pad comprises at least one of a linear polishing pad and a rotary polishing pad.

17. The apparatus of claim 15 further comprising a polishing belt disposed along the underside of said polishing pad.

18. The apparatus of claim 15 further comprising a polytetrafluoroethylene coating disposed on a surface of said bladder near said polishing pad.

19. The apparatus of claim 15 wherein said fluid is a liquid.

20. The apparatus of claim 15 wherein said fluid comprises a magneto-rheological fluid.

21. The apparatus of claim 15 wherein said fluid comprises a magnetic fluid.

22. The apparatus of claim 15 wherein said bladder comprises a flexible sealed membrane.

23. A chemical-mechanical polishing tool for polishing a semiconductor wafer surface comprising:

a carrier for holding said semiconductor wafer;

a linear pad engaging said wafer surface by continuously moving in a linear direction relative to said wafer;

a bladder disposed along an underside of said pad for providing pressure to support said pad;

a fluid disposed within said bladder; and a plurality of flux guides disposed along the underside of said bladder to direct differential magnetic fields to selected locations of said bladder for controlling a plurality of counteracting forces against at least one force pressing said wafer against said pad such that independent pressure adjustments are made at said selected locations by adjusting viscosity of portions of said fluid by said differential magnetic fields.

24. The chemical-mechanical polishing tool of claim 23 wherein said fluid comprises a viscous fluid that changes viscosity in proportion to the magnitude of said differential magnetic fields.

25. The chemical-mechanical polishing tool of claim 23 wherein said fluid comprises a magneto-rheological fluid.

26. A polishing tool utilized to polish a material, comprising:

a polishing pad disposed adjacent to said substantially planar surface;

a bladder disposed along a portion of said polishing pad to support said polishing pad;

fluid means having a controllable viscosity disposed within said bladder; and at least one flux guide disposed along a portion of said bladder to direct a magnetic field to selected locations of said bladder for controlling said viscosity of a portion of said fluid means.

27. The polishing tool of claim 26 wherein said fluid means comprises a magnetic fluid.

28. The polishing tool of claim 26 wherein said fluid means comprises a mixture of oil and ferromagnetic shavings.

29. The polishing tool of claim 26 wherein said fluid means comprises a magneto-rheological fluid.

30. The polishing tool of claim 26 wherein said fluid means has a viscosity proportional to the magnitude of said magnetic field.

31. A method of polishing a wafer, comprising:

providing a linear pad that is moving continuously in a linear direction relative to a surface of said wafer when said surface is engaged against said pad;

providing a bladder disposed along an underside portion of said pad for providing fluid pressure to support said pad;

providing a fluid disposed within said bladder; and providing a plurality of flux guides disposed along the underside of said bladder to direct a magnetic field to a selected location of said bladder for controlling a counteracting force against at least one force pressing said wafer against said pad; and adjusting said magnetic field such that an independent pressure adjustment occurs at said selected location of said bladder by adjusting the hardness of a portion of said fluid by generating a differential magnetic field.

32. The method of claim 31 wherein said surface being polished is a pure silicon layer.

33. The method of claim 31 wherein said surface being polished is a semiconductor device layer.

34. The method of claim 31 wherein said fluid comprises a magnetic fluid.

35. The method of claim 31 wherein said fluid comprises a magneto-rheological fluid.

36. The method of claim 31 wherein said fluid comprises a powder.

* * * * *